US010068562B1

(12) United States Patent
Christ

(10) Patent No.: US 10,068,562 B1
(45) Date of Patent: Sep. 4, 2018

(54) DUAL-CHAMBER WHISTLE

(71) Applicant: John Christ, Ozone Park, NY (US)

(72) Inventor: John Christ, Ozone Park, NY (US)

( * ) Notice: Subject to any disclaimer, the term of this patent is extended or adjusted under 35 U.S.C. 154(b) by 205 days.

(21) Appl. No.: 15/201,722

(22) Filed: Jul. 5, 2016

(51) Int. Cl.
*G10K 5/00* (2006.01)

(52) U.S. Cl.
CPC ..... *G10K 5/00* (2013.01)

(58) Field of Classification Search
CPC ..... G10K 5/00; G10K 5/02
USPC ..... 116/137 R; 446/204, 205, 206
See application file for complete search history.

(56) References Cited

U.S. PATENT DOCUMENTS

| | | | | |
|---|---|---|---|---|
| 1,688,349 | A * | 10/1928 | Petrie | G10K 5/00 446/26 |
| 1,744,570 | A | 1/1930 | Surteens | |
| 2,053,982 | A * | 9/1936 | Weiss | G10K 5/00 116/137 R |
| 2,454,105 | A * | 11/1948 | Thompson | G10K 5/00 116/148 |
| 4,709,651 | A | 12/1987 | Lance | |
| 5,546,887 | A | 8/1996 | Cameron | |
| D409,939 | S | 5/1999 | Sharp | |
| 7,428,878 | B2 * | 9/2008 | Kim | G10K 5/00 116/137 R |
| 7,581,509 | B2 | 9/2009 | Eventoff | |
| 2003/0116078 | A1 * | 6/2003 | Topman et al. | G10K 5/00 116/137 R |

FOREIGN PATENT DOCUMENTS

| | | | | |
|---|---|---|---|---|
| GB | 191220079 A | * | 9/1913 | G10K 5/00 |
| WO | 0152235 A1 | | 7/2001 | |

* cited by examiner

*Primary Examiner* — R. A. Smith
(74) *Attorney, Agent, or Firm* — Kyle A. Fletcher, Esq.

(57) ABSTRACT

The dual-chamber whistle is a sound producing device that creates a first air flow, a second air flow and a third air flow within the dual-chamber whistle. The basic sound of the dual-chamber whistle is generated by a first turbulence created the interaction of the first air flow and the second air flow. The third air flow also interacts with both the first air flow and the second air flow to create a second turbulence. This second turbulence creates an additional sound called the oversound. While actual patterns of turbulences created in both the first turbulence and the second turbulence are essentially random, the human psychological response to the oversound is to interpret the oversound as an actual call for help. The dual-chamber whistle comprises an intake, an exhaust, and a router which creates a complex air flow.

17 Claims, 3 Drawing Sheets

DUAL-CHAMBER WHISTLE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of musical instruments, more specifically, a sound producing device.

Traditional whistles are sound producing devices that are often used to attract attention for a variety of purposes. Most traditional whistles operate by generating turbulence within an air flow. Common traditional whistles generate this turbulence in two ways. The first way is to divide the air flowing through traditional whistle into a first air flow and a second air flow using a device called the lip. The first air flow is routed immediately out of the traditional whistle through an aperture called the window. The second air flow enters a chamber that is designed to deflect the second air flow through a nonlinear (often circular) path back to the window where the second air flow also escapes. As the path of the second air flow crosses the path of the first air flow, a turbulence is created that creates a sound. The sound of this turbulence can be enhanced by placing a ball within the chamber. The second air flow will move the ball thereby creating additional turbulence which further enhances the sound created. The air flow is initiated into a traditional whistle through the use of a mouthpiece and a channel referred to as the bore.

SUMMARY OF INVENTION

The dual-chamber whistle is a sound producing device that creates a first air flow, a second air flow and a third air flow within the dual-chamber whistle. The basic sound of the dual-chamber whistle is generated by a first turbulence created by the interaction of the first air flow and the second air flow. The third air flow also interacts with both the first air flow and the second air flow to create a second turbulence. This second turbulence creates an additional sound called the oversound. While actual patterns of turbulences created in both the first turbulence and the second turbulence are essentially random, the human psychological response to the sound of dual-chamber whistle is predictable. Specifically, the base sound of the dual-chamber whistle will cause a person to respond to the dual-chamber whistle as if the base sound came from a traditional whistle. Because the oversound of the dual-chamber whistle is unexpected, the person's brain will "interpret" the oversound. Because the typical person is conditioned to respond the base sound as signaling an emergency situation, the person's brain will typically interpret the oversound as an actual call for help.

These together with additional objects, features and advantages of the dual-chamber whistle will be readily apparent to those of ordinary skill in the art upon reading the following detailed description of the presently preferred, but nonetheless illustrative, embodiments when taken in conjunction with the accompanying drawings.

In this respect, before explaining the current embodiments of the dual-chamber whistle in detail, it is to be understood that the dual-chamber whistle is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the dual-chamber whistle.

It is therefore important that the claims be regarded as including such equivalent construction insofar as they do not depart from the spirit and scope of the dual-chamber whistle. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
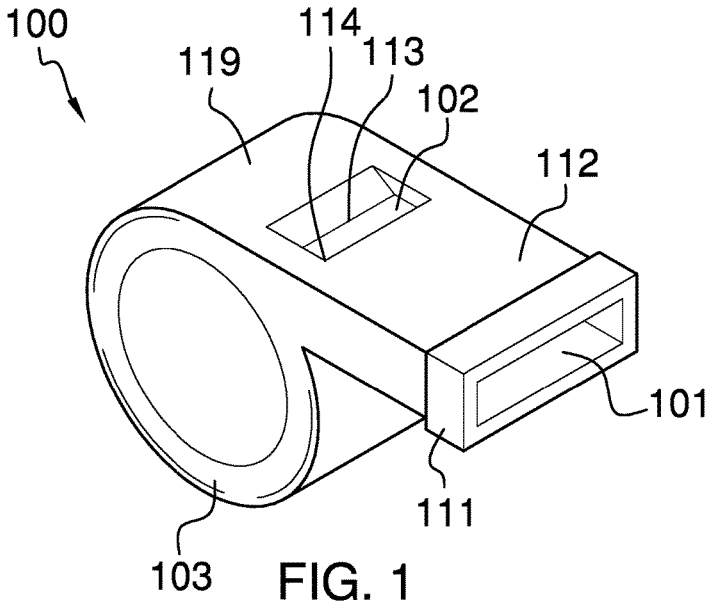
FIG. 1 is a perspective view of an embodiment of the disclosure.
Figure 2:
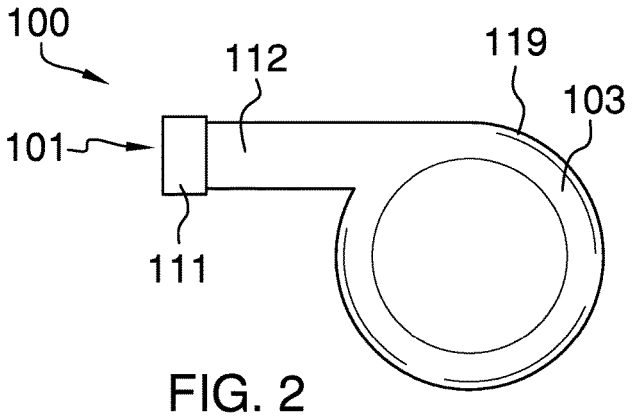
FIG. 2 is a side view of an embodiment of the disclosure.
Figure 3:
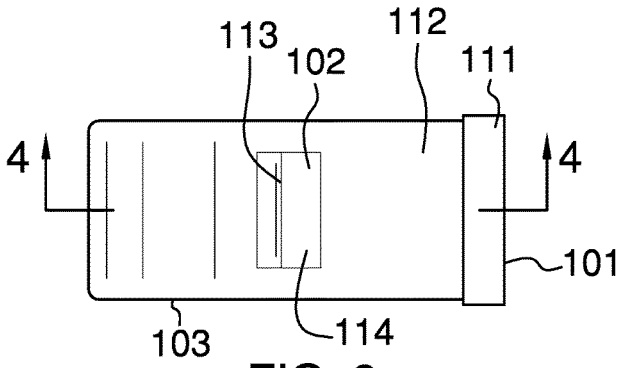
FIG. 3 is a top view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 5.

The dual-chamber whistle 100 (hereinafter invention) comprises an intake 101, an exhaust 102, and a router 103 which creates a complex air flow 104. The invention 100 is a sound producing device that creates a complex air flow 104 within the invention 100. The intake 101 and the exhaust 102 are attached to the router 103. The intake 101 receives the air flow into the invention 100 and routes the air flow into the router 103. The exhaust 102 releases the complex air flow 104 generated by the router 103 thereby creating the base sound 161 and the oversound 162 of the invention 100. The router 103 is designed to create the complex air flow 104 in a manner that creates turbulences with the complex air flow 104 that generate the sound produced by the invention 100. The turbulence created within the complex air flow 104 creates a first turbulence and a second turbulence that generates a base sound 161 and an additional sound called the oversound 162 respectively. While actual patterns of turbulences created in the both the first turbulence and the second turbulence are essentially random, the human psychological response to the sound of invention 100 is predictable. Specifically, the base sound 161 of the invention 100 will cause a person 151 to respond to the invention 100 as if the base sound 161 came from a traditional whistle. Because the oversound 162 of the invention 100 is unexpected, the person's 151 brain will "interpret" the oversound 162. Because the typical person 151 is conditioned to respond the base sound 161 as signaling an emergency situation, the person's 151 brain will typically interpret the oversound 162 as an actual call for help.

The complex air flow 104 comprises a first air flow 131, a second air flow 132, and a third air flow 133. The first turbulence is generated by the interaction of the first air flow 131 and the second air flow 132. The second turbulence is generated by the interaction of the third air flow 133 with both the first air flow 131 and the second air flow 132. The first turbulence creates the base sound 161. Because the first turbulence is generated by a process that is similar to the traditional whistle, the base sound 161 is the sound that a human is conditioned to expect when a traditional whistle is blown. The generation of the second turbulence creates the oversound 162 and the resulting interpretation of the call for help.

The exhaust 102 comprises a lip 113 and a window 114. The lip 113 is a blade like device that splits the air flowing from the intake 101 into the router 103 into the first air flow 131 and the second air flow 132. The first air flow 131 is routed directly out the window 114. The window 114 is a first aperture that is formed within the shell 119 within which the invention 100 is contained. The window 114 permits the release of the complex air flow 104 that generates the base sound 161 and the oversound 162. The second air flow 132 is directed into the router 103.

The router 103 comprises a first chamber 115 and a second chamber 116. The first chamber 115 is a first cylindrical space contained within the router 103. The second chamber 116 is a second cylindrical space that is fully contained within the first chamber 115. As the second air flow 132 enters the first chamber 115, the first inner face 141 of the first cylindrical space routes the second air flow 132 in a circular pattern that creates in effect a first vortex. The boundary layer between the second air flow 132 and the first inner face 141 generates the first turbulence of the invention 100. The first chamber 115 is designed such that the second air flow 132 and the associated first turbulence are released directly into the window 114. The first chamber is designed such that the second air flow 132 and the associated first turbulence pass perpendicularly through the first air flow 131. This perpendicular interaction between the first air flow 131 and the second air flow 132 will generate additional turbulence to enhance the sound producing effect of the first turbulence.

Figure 4:
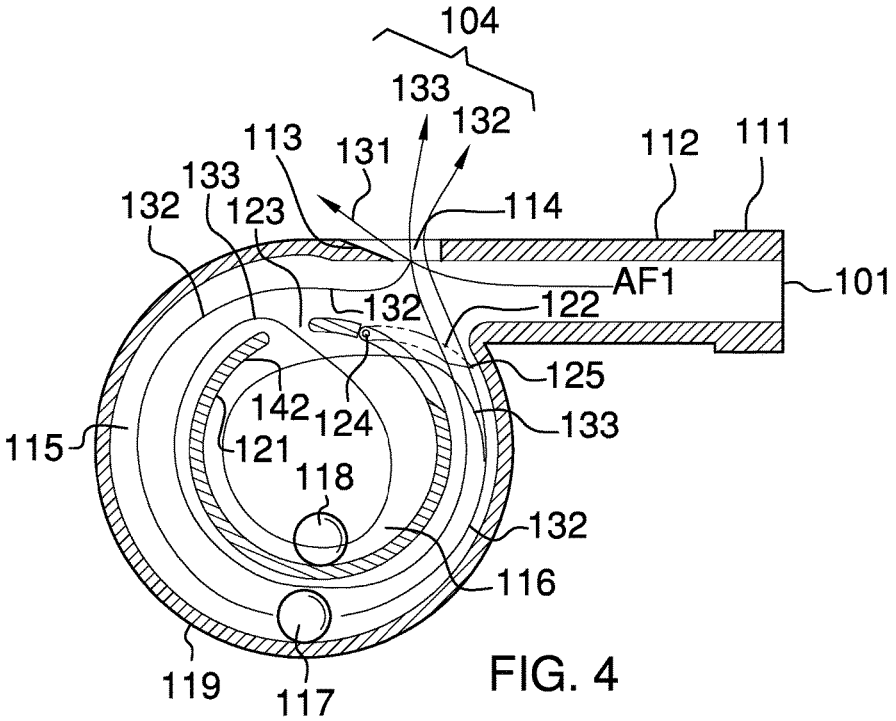
FIG. 4 is a cross-sectional view of an embodiment of the disclosure across 4-4 as shown in FIG. 3.
Figure 5:
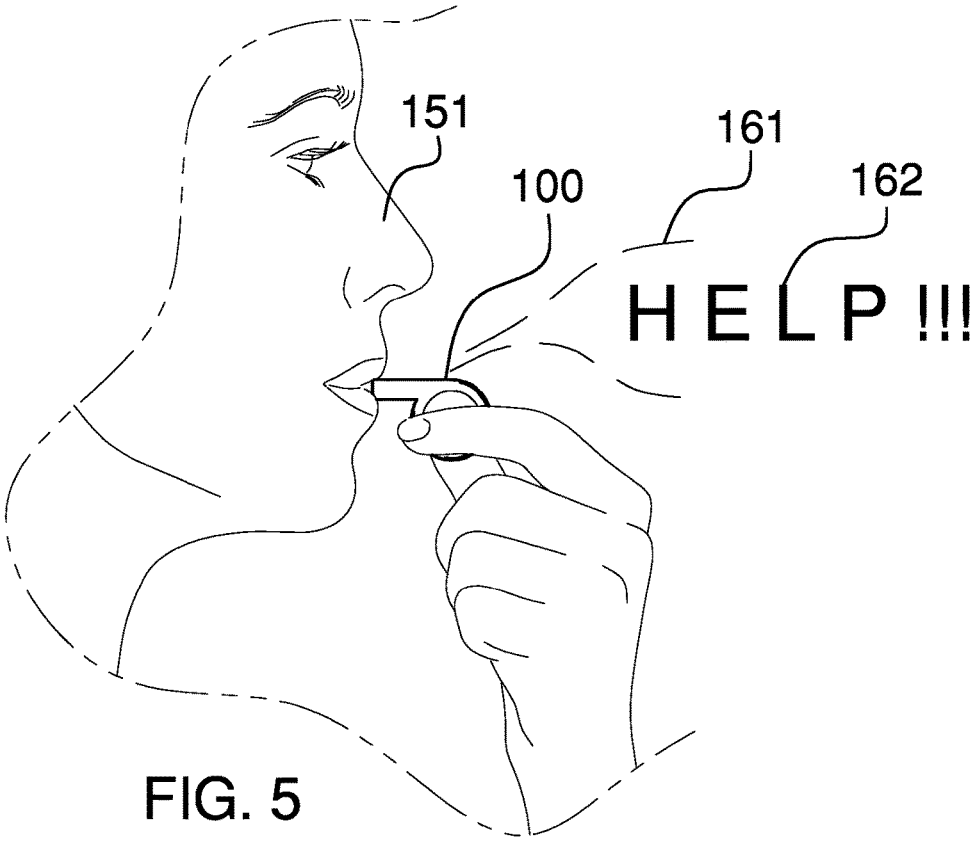
FIG. 5 is an in use view of an embodiment of the disclosure.

As shown most clearly in FIG. 4, the second chamber 116 further comprises a second chamber wall 121, a second chamber valve 122, and a second chamber escape 123. The boundary of the second chamber 116 within the first chamber 115 is defined by the second chamber wall 121. The second chamber wall 121 creates the second cylindrical space that is further defined with a second inner face 142. The second chamber valve 122 comprises a hinged 124 flap 125 that is formed in the second chamber wall 121. The flap 125 has a curvature that matches the curvature of the second chamber wall 121. The flap 125 is attached to the second chamber wall 121 with the hinge 124. The flap 125 is attached to the second chamber wall 121 such that the flap 125 can rotate into the first chamber 115 using the hinge 124 as pivot. The second chamber escape 123 is a second aperture that is formed in the second chamber wall 121 to allow air flow to escape from the second chamber 123 back into the first chamber 115.

As the second air flow 132 and the associated first turbulence flows through the first chamber 115 a pressure differential will randomly occur between the air pressure within the second chamber 116 and the first chamber 115. This pressure differential will cause the second chamber valve 122 to open into the second air flow 132 through the first chamber 115. As shown in FIG. 4, when the flap 125 moves into the second air flow 132, the curvature of the flap 125 will divert a portion of the mass of the second air flow 132 into the second chamber 116 creating third air flow 133.

As the third air flow 133 enters the second chamber 116, the second inner face 142 of the second cylindrical space routes the third air flow 133 in a circular pattern that creates in effect a second vortex. The boundary layer between the third air flow 133 and the second inner face 142 generates the second turbulence of the invention 100. The second chamber 116 is designed such that the third air flow 133 and the associated second turbulence are released directly into the first chamber 115. The second turbulence generated by the third air flow 133 is physically separated by distance from the first turbulence. While the second air flow 132 and the third air flow 133 will mix at the boundary, it is anticipated by the inventor that the bulk of the mass of the second air flow 132 and first turbulence will remain separated from the third air flow 133 and the second turbulence. After leaving the second chamber 116 through the second chamber escape 123, the third air flow 133 will follow the same path as the second air flow 132 to exit through the window 114. The differences between the second air flow 132 and the third air flow 133 are sufficient to ensure that the interaction between the third air flow 133 and the first air flow 131 plus the less prominent interaction between the third air flow 133 and the second air flow 132 will create a distinct oversound 162.

In a second potential embodiment of the disclosure, the router 103 further comprises a first ball 117. The first ball 117 is placed in the first chamber 115. The momentum of the mass flow of the second air flow 132 and the third air flow 133 is sufficient to move the first ball 117. This motion of the first ball 117 creates additional turbulences in the first turbulence and the second turbulence that will affect the base sound 161 and the oversound 162.

In a third potential embodiment of the disclosure, the router 103 further comprises a second ball 118. The second ball 118 is placed in the second chamber 116. The momentum of the mass flow of the third air flow 133 is sufficient to move the second ball 118. This motion of the second ball 118 creates additional turbulences in the second turbulence that will affect the base sound 161 and the oversound 162.

The intake 101 comprises a mouthpiece 111 and a bore 112. The mouthpiece 111 is a third aperture into which air is blown by a person 151. The mouthpiece 111 is attached to the router 103 with the bore 112. The bore 112 is a tubular device that routes air from the mouthpiece 111 into the first chamber 115 such that the initial air flow will flow past the lip 113.

The invention 100 is used like a traditional whistle.

The following definitions were used in this disclosure:

Blade: As used in this disclosure, a blade is a term that is used to describe: 1) a wide and flat portion of a structure; or, 2) the cutting edge of a tool.

Hinge: As used in this disclosure, a hinge is a device that permits the turning, rotating, or pivoting of a first object relative to a second object.

Pivot: As used in this disclosure, a pivot is a rod or shaft around which an object rotates or swings.

With respect to the above description, it is to be realized that the optimum dimensional relationship for the various components of the invention described above and in FIGS. 1 through 5 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A sound producing device comprising:
an intake, an exhaust, and a router;
wherein the intake, the exhaust, and the router create a complex air flow;
wherein the intake and the exhaust are attached to the router;
wherein the intake receives an initial air flow into the invention and routes the initial air flow into the router;
wherein the exhaust releases the complex air flow from the sound producing device;
wherein the complex air flow create a base sound and an oversound;
wherein when heard by a person the oversound is interpreted as a call for help;
wherein the complex air flow comprises a first air flow, a second air flow, and a third air flow;
wherein a first turbulence is generated by the interaction of the first air flow and the second air flow;
wherein a second turbulence is generated by the interaction of the third air flow with both the first air flow and the second air flow;
wherein the first turbulence generates the base sound;
wherein the second turbulence generates the oversound.

2. The sound producing device according to claim 1
wherein the exhaust comprises a lip and a window;
wherein the lip is a blade that splits the initial air flow into the first air flow and the second air flow;
wherein the window is a first aperture;
wherein the first air flow is routed directly out the window;
wherein the second air flow is directed into the router.

3. The sound producing device according to claim 2
wherein the router comprises a first chamber and a second chamber;
wherein the first chamber is a first cylindrical space contained within the router;
wherein the second chamber is a second cylindrical space that is fully contained within the first chamber;
wherein the first chamber further comprises a first inner face;
wherein the second chamber further comprises a second inner face.

4. The sound producing device according to claim 3
wherein the first inner face of the first cylindrical space routes the second air flow in a circular pattern that creates in effect a first vortex;
wherein the boundary layer between the second air flow and the first inner face generates the first turbulence.

5. The sound producing device according to claim 4
wherein the first chamber releases the second air flow and the associated first turbulence into the window;
wherein the second air flow and the associated first turbulence pass perpendicularly through the first air flow.

6. The sound producing device according to claim 5
wherein the second chamber further comprises a second chamber wall, a second chamber valve, and a second chamber escape;
wherein the second chamber wall creates the boundary between the second chamber and the first chamber;
wherein the second chamber valve forms a part of the second chamber wall;
wherein the second chamber escape is a second aperture that is formed in the second chamber wall.

7. The sound producing device according to claim 6
wherein the second chamber wall creates a second cylindrical space;
wherein the second chamber wall further comprises a second inner face.

8. The sound producing device according to claim 7
wherein the second chamber valve comprises a hinge and a flap;
wherein the hinge and the flap are formed in the second chamber wall;
wherein the flap has a curvature that matches the curvature of the second chamber wall;
wherein the flap is attached to the second chamber wall with the hinge.

9. The sound producing device according to claim 8 wherein the flap is attached to the second chamber wall such that the flap rotates into the first chamber using the hinge as pivot.

10. The sound producing device according to claim 9
wherein the rotation of the flap into the first chamber diverts mass from the second air flow into the second chamber;
wherein this diverted mass from the second air flow forms the third air flow.

11. The sound producing device according to claim 10
wherein the second inner face of the second cylindrical space routes the third air flow in a circular pattern that creates in effect a second vortex;
wherein the boundary layer between the third air flow and the second inner face generates a second turbulence.

12. The sound producing device according to claim 11 wherein the third air flow and the associated second turbulence is released into the first chamber through the second chamber escape.

13. The sound producing device according to claim 12 wherein the second turbulence is physically separated by distance from the first turbulence.

14. The sound producing device according to claim 13
wherein the first chamber releases the third air flow and the associated second turbulence are into the window;
wherein the third air flow and the associated second turbulence pass perpendicularly through the first air flow.

15. The sound producing device according to claim 14
wherein the router further comprises a first ball;
wherein the first ball is placed in the first chamber.

16. The sound producing device according to claim 15
wherein the router further comprises a second ball;
wherein the second ball is placed in the second chamber.

17. The sound producing device according to claim 16
wherein the intake comprises a mouthpiece and a bore;
wherein the mouthpiece is a third aperture into which air is blown by a person;
wherein the mouthpiece is attached to the router with the bore;
wherein the bore is a tubular device.

* * * * *